US011774910B2

(12) United States Patent
Chevallier et al.

(10) Patent No.: US 11,774,910 B2
(45) Date of Patent: Oct. 3, 2023

(54) RESONANT MEMBER FOR A STRIKING MECHANISM OF A WATCH OR OF A MUSIC BOX

(71) Applicant: Blancpain SA, Le Brassus (CH)

(72) Inventors: Laurane Chevallier, Les Rousses (FR); Julien Peter, Gollion (CH)

(73) Assignee: Blancpain SA, Le Brassus (CH)

( * ) Notice: Subject to any disclaimer, the term of this patent is extended or adjusted under 35 U.S.C. 154(b) by 1003 days.

(21) Appl. No.: 16/672,578

(22) Filed: Nov. 4, 2019

(65) Prior Publication Data

US 2020/0166892 A1 May 28, 2020

(30) Foreign Application Priority Data

Nov. 22, 2018 (EP) ..... 18207831

(51) Int. Cl.
*G04B 21/08* (2006.01)
*G04B 21/06* (2006.01)

(52) U.S. Cl.
CPC ..... *G04B 21/08* (2013.01); *G04B 21/06* (2013.01)

(58) Field of Classification Search
CPC ..... G04B 21/08; G04B 21/06
USPC ..... 368/272
See application file for complete search history.

(56) References Cited

U.S. PATENT DOCUMENTS 3,974,001 A * 8/1976 Steinemann ..... C22C 27/04 420/466
2008/0074956 A1* 3/2008 Karapatis ..... G04B 21/08 368/243
2012/0140603 A1 6/2012 Sarchi et al.
2012/0192697 A1* 8/2012 Favre ..... G10F 1/06 84/94.1
2014/0104994 A1 4/2014 Raggi et al.
2014/0355398 A1* 12/2014 Karapatis ..... G04B 23/028 368/243
2015/0323902 A1* 11/2015 Rochat ..... G04B 21/08 368/272
2016/0306325 A1* 10/2016 Karapatis ..... G10K 1/067
2017/0248921 A1* 8/2017 Kadmiri ..... G04B 21/12

FOREIGN PATENT DOCUMENTS

CH 710206 A2 * 4/2016 ..... G04B 21/08
EP 1 906 267 A1 4/2008
EP 1 914 606 A1 4/2008
(Continued)

OTHER PUBLICATIONS

European Search Report dated Aug. 23, 2019 in European Application 18207831.1 filed on Nov. 22, 2018 (with English Translation of Categories of Cited Documents)
(Continued)

*Primary Examiner* — Edwin A. Leon
*Assistant Examiner* — Kevin Andrew Johnston
(74) *Attorney, Agent, or Firm* — Oblon, McClelland, Maier & Neustadt, L.L.P.

(57) ABSTRACT

A resonant member for a striking mechanism of a watch or of a music box includes at least one resonant part, such as one or more gongs, arranged to vibrate and resonate once activated, and an attachment part. The resonant part and/or the attachment part is made from an alloy of palladium or platinum with more than 51% of palladium or platinum in the alloy.

20 Claims, 2 Drawing Sheets

(56) References Cited

FOREIGN PATENT DOCUMENTS

| | | | |
|---|---|---|---|
| EP | 2 207 069 | A2 | 7/2010 |
| EP | 2 461 219 | A1 | 6/2012 |
| EP | 2 808 745 | A1 | 12/2014 |
| EP | 2 942 674 | A1 | 11/2015 |
| EP | 3 211 488 | A1 | 8/2017 |
| JP | 2010-160155 | A | 7/2010 |
| JP | 2012-118068 | A | 6/2012 |
| JP | 2014-81 374 | A | 5/2014 |
| JP | 2017-502359 | A | 1/2017 |

OTHER PUBLICATIONS

Notice of the Reason for Refusal dated Feb. 9, 2021 in Japanese Patent Application No. 2019-211086 (with English language translation), 7 pages.

* cited by examiner

RESONANT MEMBER FOR A STRIKING MECHANISM OF A WATCH OR OF A MUSIC BOX

CROSS-REFERENCE TO RELATED APPLICATION

This application claims priority to European Patent Application No. 18207831.1 filed on Nov. 22, 2018, the entire disclosure of which is hereby incorporated herein by reference.

FIELD OF THE INVENTION

The invention concerns a resonant member, which includes at least one resonant part, such as one or more gongs, or a vibration plate for a striking mechanism of a watch or of a music box. The gong or gongs or each strip of a vibration plate must be designed with a specific material to take account of the space available inside the watch case while ensuring a rich sound generated when the gong or gongs are struck, or one or more strips are activated.

The invention also concerns a method for making a resonant member.

STATE OF THE ART

In the field of horology, a timepiece movement may be provided with a striking mechanism, such as a minute repeater. To this end, the resonant member used includes a gong, which is a metal wire of circular shape, made, for example, of steel. This metal wire is generally disposed around the movement, inside the watch case. The gong is fixed, for example by welding or soldering, to a gong-carrier, which is itself integral with the main plate or the middle part of the watch case. The gong vibration is generated by the impact, generally in proximity to the gong-carrier, of at least one hammer. This vibration is composed of several natural frequencies or partials, the number and intensity of which, especially in the audible range between 1 kHz and 20 kHz, depend on the geometry of the gong and the physical properties of the material used.

The gong in the form of a metal wire can also be made of gold, as described in European Patent No. EP 2 107 436 B1, in order to have a large number of partials in the sound vibration generated by the hammer strike. Although making a gong from gold provides great richness for the sound generated when the striking mechanism hammer strikes, it may undergo excessive deformation due to its own weight. Since space may be limited inside the watch case where the gong is located, it can easily come into undesired contact with adjacent components. This constitutes a drawback of a gong made of gold or any metal with high density and a low modulus of elasticity.

In such conditions, noise insulators could be placed around the gong or gongs of the mechanism to prevent such inadvertent shocks or ringing. However, space is greatly reduced in conventional watches for noise insulators to also be added between the gong or gongs, while ensuring richness of the sound generated when the gong or gongs are struck at desired times.

Naturally, a timepiece movement can also include a striking mechanism to generate music if the mechanism is activated. To this end, the mechanism may include a resonant member in the form of a musical vibration plate. The strips made of metallic material can be activated by pins disposed on a disc or cylinder driven in rotation during activation of the striking mechanism. The same drawbacks as for an arrangement of one or more gongs made of an aforementioned material can be observed in the case of a vibration plate with metal strips.

It is also to be noted that, in a conventional musical or striking watch, acoustic efficiency, based on the complex vibroacoustic transduction of the external parts, is low. In order to improve and increase the acoustic level of a sound or a note, the geometry and boundary conditions of the external parts must be considered. The configuration of the external parts is also dependent on the aesthetics of the watch and operating constraints, which may limit possibilities of adaptation.

European Patent Application No. EP 3 211 488 A1 discloses a gong for a striking mechanism, which is obtained by a moulding or wire drawing or wire cutting operation or by stamping a plate of metal material in a machining device. The gong can be made in one piece with the gong-carrier. The gong may be made of metallic glass, which may be palladium-based. However, nothing is specified for making such a gong capable of generating a rich sound once activated and with low deformation due to its own weight, which constitutes a drawback.

SUMMARY OF THE INVENTION

It is therefore an object of the invention to overcome the drawbacks of the state of the art by providing a resonant member, which includes one or more gongs or a vibration plate for a striking mechanism of a watch or of a music box, exhibiting less deformation due to its own weight and capable of producing a rich, warm and loud sound once activated in a reduced space inside the watch or music box.

To this end, the invention also concerns a resonant member, which includes the features of a resonant member for a striking mechanism of a watch or of a music box, which may comprise at least one resonant part arranged to vibrate and resonate once activated, wherein at least the resonant part is made from a palladium or platinum alloy with more than 51% by weight of palladium or platinum in the alloy.

Specific embodiments of the resonant member include members having an attachment part made integral with the resonant part in one-piece form. The palladium or platinum alloy may be determined such that the ratio between the Young's modulus and the density or specific mass is smaller than $28 \cdot 106\ (m/s)^2$. The hardness of the resonant part and/or of an attachment part may be greater than 150 HV. The resonant part may include one or more gongs. The resonant part may comprise at least two gongs capable of being disposed one atop the other inside a watch case and having different lengths in order to each generate a specific different note once activated for a minute repeater. The resonant part may comprise at least four gongs having different lengths in order to each generate a specific different note once activated for a chime mechanism, wherein a first gong and a second gong are capable of being placed one atop the other inside a watch case, wherein a third gong and a fourth gong are capable of being placed one atop the other inside a watch case, in that the third gong is intended to be coaxially mounted inwardly and in the same plane as the first gong, and wherein the fourth gong is intended to be coaxially mounted inwardly and in the same plane as the second gong. Gongs may be connected at one end to the attachment part and another end is free to move, and the gong may be of circular shape to be disposed inside a watch case describing a circular sector with an angle of between 185° and 220°. The gong may have a circular or rectangular cross-section of dimensions greater than or equal to 0.4 mm. The palladium or platinum alloy may contain one or more materials such as silver, zinc, indium, tin, titanium, copper, nickel, beryllium, aluminum, ruthenium, gallium, lithium, iridium, germanium, boron, zirconium. The resonant member may be made of metallic glass with more than 51% by weight of palladium or platinum. The gong(s) may be obtained by milling, electroerosion, laser machining, molding, casting, or hot pressing.

One advantage of the resonant member lies in the fact that it is made from a palladium or platinum alloy containing more than 51% by weight of palladium or platinum. Further, preferably, such an alloy is chosen with a ratio E/ρ of Young's modulus E to density or specific mass ρ which is close to that of gold. Ratio E/ρ must, for example, be less than $28 \cdot 10^6$ $(m/s)^2$. Once activated, this makes it possible to generate a rich loud sound having a large number of partials in the audible range from at least 1 kHz to 10 kHz.

Advantageously, the resonant member can comprise a resonant part connected in one piece to an attachment part. The resonant part may comprise one or more gongs and the attachment part may be defined as a gong-carrier connecting one or more gongs, or one gong-carrier per gong.

Advantageously, the resonant member, which includes one or more gongs, is intended to be made in such a way as to minimise any deformation thereof due to its own weight once mounted inside a watch case and with a reduced space for the positioning of the gong(s). The gong(s) can also be made of a palladium or platinum alloy with a hardness of more than 150 HV, and preferably more than 300 HV.

Advantageously, the resonant member may be a musical vibration plate formed of several strips connected to a same bar-like portion in one-piece. Each strip or each group of strips can be made to each produce a well-defined note once activated.

To this end, the invention also concerns a method for making a resonant member. Such a method for making a resonant member may comprises making the resonant member of a palladium or platinum alloy with more than 51% by weight of palladium or platinum, and heat treating the obtained resonant member to augment its mechanical properties, its resistance to corrosion and/or its acoustic properties. Such a method may comprise making the resonant member from a palladium or platinum alloy with more than 51% by weight of palladium or platinum, and surface treating to form an additional surface layer of the alloy to improve its resistance to corrosion and/or its surface hardness.

BRIEF DESCRIPTION OF THE DRAWINGS

The objects, advantages and features of a resonant member, which includes one or more gongs or a vibration plate for a striking mechanism of a watch or of a music box will appear more clearly in the following description, particularly with reference to the drawings, in which.

DETAILED DESCRIPTION OF THE INVENTION

In the following description, all the parts of a striking mechanism, which includes a resonant member of a striking or musical watch, which are well known in this technical field will be only briefly described. The emphasis is mainly on the resonant member and the making thereof for the striking mechanism in the watch case, or in a music box.

Figure 1:
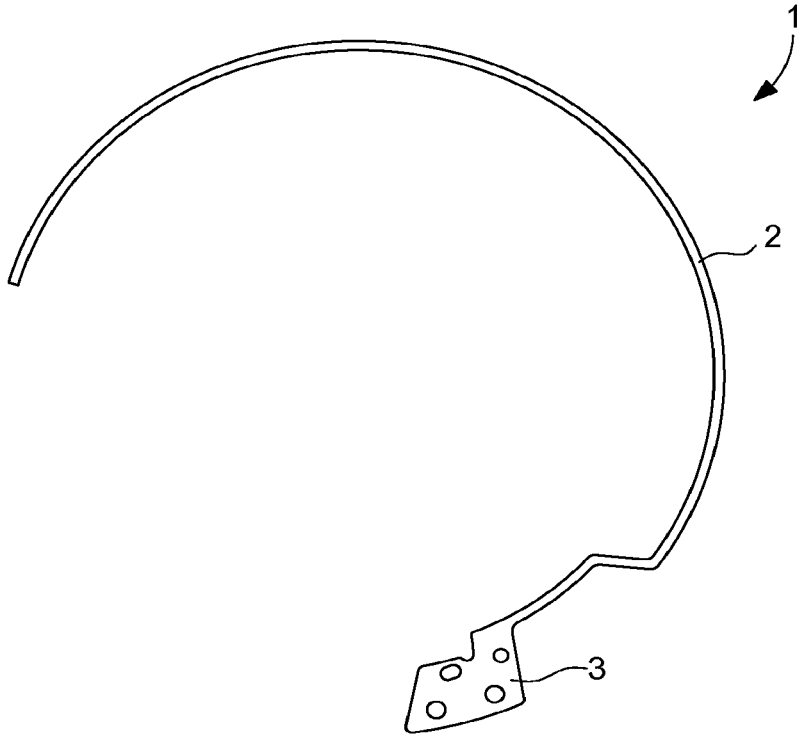
FIG. 1 represents a top view of a resonant member in the form of a gong connected to an attachment part of a striking mechanism, notably of a watch, according to the invention.

FIG. 1 represents a resonant member 1, which includes a resonant part 2 and an attachment part 3. Resonant part 2 in this case includes a gong 2, and attachment part 3 is a plate in the form of a gong-carrier in the extension of a first end of gong 2. Generally, the other end of gong 2 is free. Resonant part 2 and attachment part 3 preferably form a single component, i.e. they are made in one piece from the same material. According to the invention, the material used is an alloy, which contains at least 51% by weight of palladium or platinum.

Attachment part 3 may be of the same thickness as the thickness of gong 2 and includes pierced holes for the attachment, for example by means of screws, of gong 2 to a corresponding portion of a middle part of the watch case or of a plate of the timepiece movement. Attachment part 3 may also have a different shape and a different thickness or be integral with a portion of the watch case middle.

Gong 2 of the watch striking mechanism may be disposed inside the watch case, preferably underneath a watch dial and, in one embodiment, partly around a timepiece movement. In these conditions, it may be circular in shape with a diameter corresponding to the diameter of the watch crystal and describing a circular sector with an angle which may be between 150° and 250°, preferably between 185° and 220°. Gong 2 may have a circular or preferably rectangular cross-section in the Figures shown. Exemplary dimensions are described below without limitation to the examples described.

Gong 2, secured by attachment part 3 inside the watch case, generally forms part of a striking mechanism, which also preferably includes a hammer for striking the gong at predetermined times. An impact portion of the hammer (not represented) generally strikes the gong in proximity to the connection thereof to attachment part 3 to generate acoustic resonance.

Depending on the material used to make resonant member 1, there may be a significant deformation of resonant part 2 once resonant member 1 is secured inside the watch case or inside the music box. Once secured, resonant part 2 may bend, i.e. deform as a function of its own weight, even when the watch is at rest. In the case of a resonant part 2 formed of one or more gongs and since the space where the gongs are situated is very limited, any movement or impact of the watch can cause the gong(s) 2 to come into contact with an adjacent gong or a close watch component. This may lead to undesired ringing of the gong(s) independently of the normal activation thereof at determined times, which is not desired.

Figure 2A:
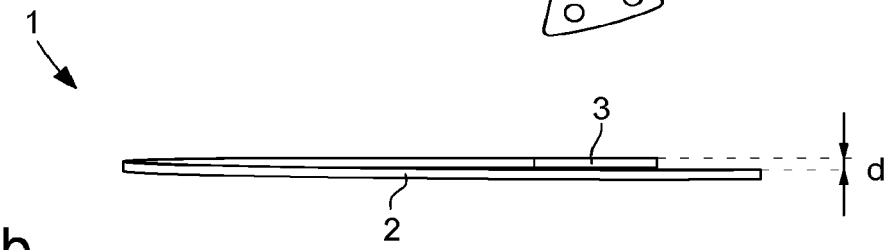
FIGS. 2*a* and 2*b* represent side and top views of a gong connected to an attachment part, as shown in FIG. 1, with a deformation of the gong due to its weight according to the invention.
Figure 2B:
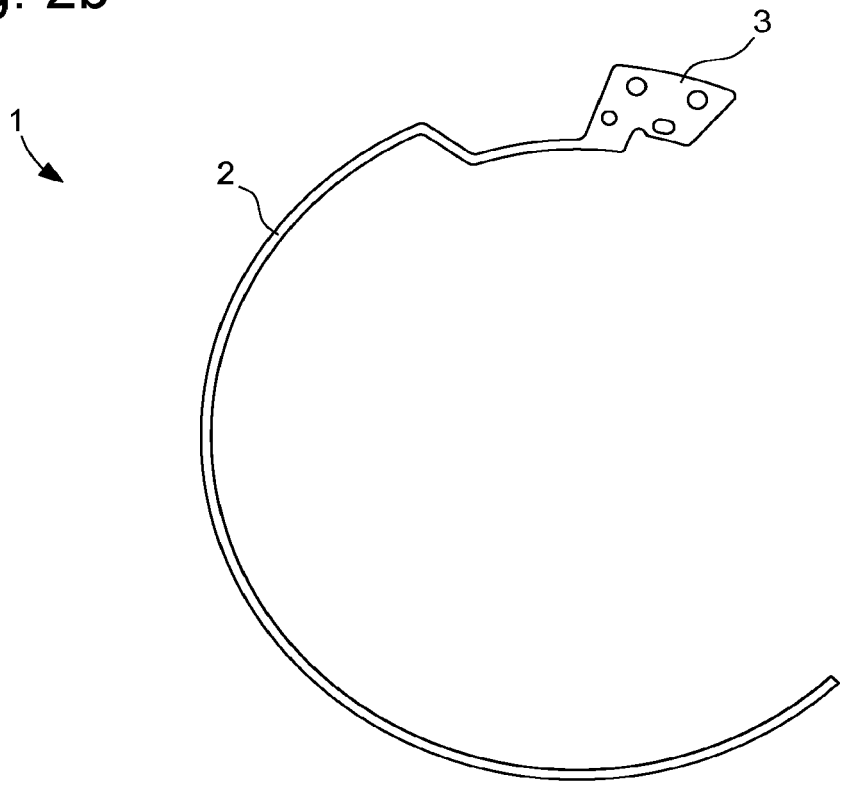

Thus, FIGS. 2*a* and 2*b* represent the deformation of a gong 2 of resonant member 1. Resonant member 1 is secured by means of attachment part 3 on a support inside the watch case. This support, which is not represented, may, for example, be a portion of the middle part of the watch case or a support on an assembly plate of the timepiece movement. It may also be a support inside a music box. Once mounted, gong 2 of resonant member 1 is, in principle, disposed in a plane parallel to and immediately below the watch dial. However, even in a rest state on a table or in a presentation case, the weight of the gong from its attachment has the effect of making it bend, i.e. to deform under its own weight.

In a rest mode, gong 2, describing a circular sector, is deflected by a distance d seen in elevation from its attachment part 3 at its free end. Depending on the space reserved for the gong or for a set of gongs in the watch case, such a gong 2 with a diameter, for example, on the order of 35 to 40 mm on a circular sector between 185° and 220° for the note G for example, and with a thickness and width greater than or equal to 0.4 mm, preferably close to 0.5 mm, must have a deflection distance d that is less than 20% of its cross-section, i.e. less than 0.1 mm in the case of the present invention.

As indicated above, according to the present invention, resonant member 1 with one or more gongs 2 is made from an alloy with more than 51% by weight of palladium or platinum in the alloy and whose ratio E/ρ is smaller than $28 \cdot 10^6$ $(m/s)^2$. Further, said palladium or platinum alloy could also be made with a hardness of more than 150 HV. A list of materials is indicated below.

The table below summarizes the criteria, which correspond to 5N gold and to alternative materials, which comprise, in particular, at least 51% by weight of palladium or platinum:

| | 5N gold | Alternative materials >51% by weight of palladium or platinum |
|---|---|---|
| Deformation of the gong under its own weight (simulation) | 0.223 mm | ≤0.1 mm |
| Ratio E/ρ | $5.4 \cdot 10^6$ $(m/s)^2$ | Smallest possible to come close to the E/ρ ratio of gold |
| Hardness HV | 250-280 HV | at least >150 HV |

Purely by way of non-limiting illustration, a gong 2 can be made that produces a note G when struck by a hammer of the striking mechanism. Gong 2 may be made of a palladium alloy where the proportion of palladium is more than 51% by weight. The Young's modulus E is equal to 92 GPa, density p is 9.3 g/cm$^3$ and the hardness is on the order of 500 HV. The length of the gong with a diameter of around 35 to 40 mm and a circular sector with an angle of 215.84° and ratio E/ρ is equal to $9.89 \cdot 10^6$ $(m/S)^2$. In this case, a deformation of the gong due to its own weight on the order of 0.108 mm is observed, which is close to 0.1 mm, which is desired.

It is also possible to define the deformation formula of a fixed beam, which deforms under its own weight. The beam deformation formula can be taken as an example to determine the deformation of a gong 2 of a resonant member 1 of more complex shape. Thus, the formula for calculating the deformation of this type of system, for a rectangular beam section, is as follows:

$$f_I = p \cdot L^4 / (8 \cdot E \cdot I)$$

where L is the length of the beam, p is the weight of the beam per unit of length, E is the Young's modulus, and $I = b \cdot h^3/12$ for a rectangular section where b is the width of the beam and H the height of the beam.

In our case, the gong(s) 2 are curved elements. The gong deformation calculation thus consists in extrapolating the formula initially adapted to an aforementioned fixed beam. This calculation is thus much more complex for gongs and therefore requires one calculation per finished element.

The length of at least one gong 2 is related to the desired resonance frequency:

$$fn = (\tfrac{1}{2}\pi) \cdot (\beta_n \cdot L)^2 \cdot (b/L^2) \cdot (E/(12 \cdot \rho)^{1/2}$$

where ρ the density of the material, $\beta_n \cdot L = ((2n-1)/2) \cdot \pi$ for n>5, n being the mode number.

This equation is valid for the vibration modes, which are in the striking plane. The ratio E/ρ is specific to the material of the gong. The smaller this ratio, the more partials there are and thus the richer the sound. A rich sound is heard more loudly by the human ear. Thus, with the choice of gong material, ratio E/ρ must be as small as possible and if possible close to that of gold.

It is also to be noted that changing the material for a material that deforms less than gold also makes it possible to optimise space inside the watch case. If the material deforms less, a saving can also be made in the diameter of the watch case and the thickness of the gong(s).

The alloy with more than 51% by weight of palladium or platinum can also contain one or more of the following elements: silver (Ag), zinc (Zn), indium (In), tin (Sn), titanium (Ti), copper (Cu), nickel (Ni), beryllium (Be), aluminium (Al), ruthenium (Ru), gallium (Ga), lithium (Li), iridium (Ir), germanium (Ge), boron (B), zirconium (Zr). These alloying elements can, for example, augment the mechanical properties and/or resistance to corrosion of the alloy. These elements can also be selected as a function of their phase diagram with the basic element. It may be advantageous to obtain certain phases for machinability and/or for acoustic properties. The alloy may be a metallic glass.

It is possible to envisage making the alloy with more than 51% by weight of palladium. In a particular case, the alloy may contain more than 60% by weight of palladium, while also containing nickel and copper.

The Young's modulus can be comprised between 80 and 180 GPa and the specific mass or density may be greater than 8 g/cm$^3$.

Resonant member 1, which may consist of one or more gongs 2, 2', 2", 2''' can be made by milling, electroerosion, laser machining, moulding, casting, hot pressing or another suitable machining method in this technical field. The gong or gongs 2, 2', 2", 2''' can also be produced from cast products or hot pressed products or hot or cold deformed products. This means that gongs 2, 2', 2", 2''' may be anisotropic or isotropic. These features can have an effect on the acoustic properties.

In the case of a casting process, resonant member 1 may be a metallic glass with more than 51% by weight of palladium or platinum. The metallic glass is thus isotropic, which makes it possible to obtain a resonant member 1 with a resonant part 2 capable of generating a rich loud sound once activated, compared to a resonant member 1 made of an anisotropic material.

Resonant member 1 can undergo a heat treatment in order to augment its mechanical properties, its resistance to corrosion and/or its acoustic properties, for example. Further, resonant member 1 may enjoy a surface treatment forming a surface layer of the alloy containing more than 51% by weight of palladium or platinum, which makes it possible to improve corrosion resistance and/or surface hardness, for example. The thickness of this additional layer on the basic element could be comprised between 10 nm and 200 μm. This additional layer can also serve as protection for the basic element particularly against corrosion.

Figure 3:
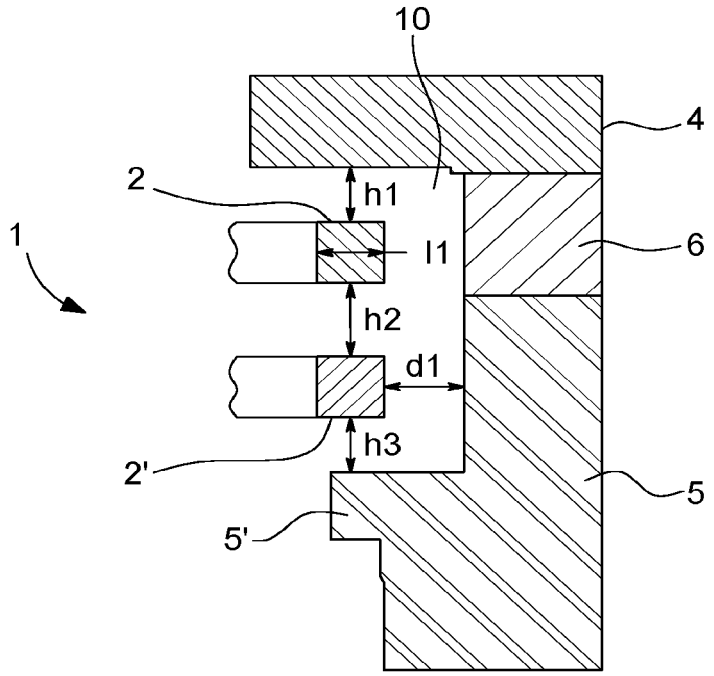
FIG. 3 represents a partial sectional view of one part of a striking or musical watch having a resonant member with two gongs for a minute repeater according to the invention.

FIG. 3 represents a partial sectional view of one part of a striking or musical watch, which includes a resonant member 1 with two gongs 2, 2' for a minute repeater according to the invention. First gong 2 of circular shape, for example, is arranged on top of second gong 2' of circular shape, for example, but of different length in order to produce a different note from the first gong once activated.

First gong 2 can be located just underneath a watch dial 4, while second gong 2' is underneath the first gong and above an inner edge 5' of watch case middle 5. A junction portion 6 connects the dial to case middle 5. A reduced space 10 is provided for the placement of gongs 2, 2', but does not guarantee that gongs 2, 2' will not knock against each other or inadvertently come into contact with the edge of vibration space 10. This depends on the material used to make the gongs, such as an alloy with more than 51% by weight of palladium or platinum.

Each gong 2, 2' has a width 11 greater than or equal to 0.4 mm. The first gong 2 is separated from dial 4 by a height h1 having approximately the value of its cross-section. The second gong is separated by a height h2 having a value less than twice its cross-section from first gong 2 without deformation. Finally, the second gong is separated by a height h3 having approximately the value of its cross-section from lower and inner edge 5' of case middle 5. The first and second gongs 2, 2' are separated from case middle 5 by a distance dl less than or equal to twice the value of their cross-section.

Figure 4:
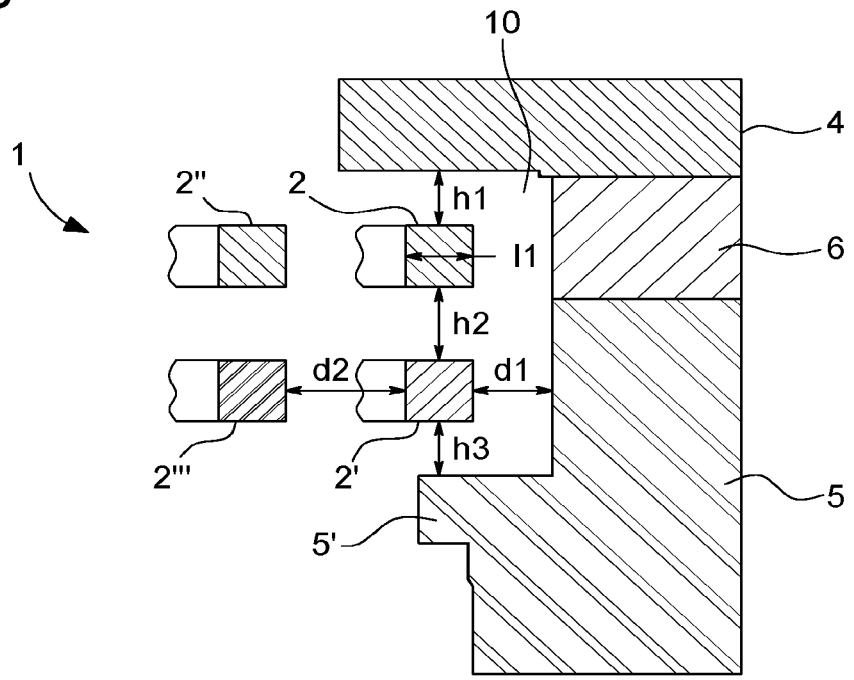
FIG. 4 represents a partial sectional view of one part of a striking or musical watch having a resonant member with four gongs for a chiming mechanism according to the invention.

FIG. 4 represents a partial sectional view of one part of a striking or musical watch, which includes a resonant member 1 with four gongs 2, 2', 2", 2'" for a chiming mechanism according to the invention. The first and second gongs 2, 2' are in the same arrangement as in the embodiment of FIG. 3. A third gong 2" is mounted coaxially inwardly and in the same plane as first gong 2. A fourth gong 2'" is coaxially mounted inwardly and in the same plane as second gong 2'. Each gong is of different length in order to each produce a specific different note once activated. The space between the first and third gongs 2, 2" and between the second and fourth gongs 2', 2'" is around twice the value of their cross-section.

Naturally other values of the dimensions of the gongs can be applied according to the dimension of the watch provided with the striking mechanism.

Two resonant parts 2 or more could be connected to a single attachment part 3. In the case of a resonant member 1 composed of gongs 2, one or more gongs 2 may be connected to a same attachment part 3, such as a gong-carrier 3, whereas other gongs 2 can each be connected to their specific different attachment part 3, such as to their own gong-carrier 3.

It is also to be noted that resonant member 1 is adapted with the material chosen to accord with the material of the external parts in order to obtain better sound transmission between the vibrating gong(s) and the adjacent external parts.

Everything described for a resonant member 1 with one or more gongs can be applied in the same manner to a resonant member 1 in the form of a vibration plate in order to play a melody once activated.

From the description that has just been given, several variants of the resonant member for a striking mechanism of a watch or of a music box can be devised by those skilled in the art without departing from the scope of the invention defined by the claims.

The invention claimed is:

1. A resonant member suitable for a striking mechanism of a watch or of a music box, the resonant member comprising:

a resonant part configured to vibrate and resonate once activated; and an attachment part integral with the resonant part in one-piece form, wherein the resonant part comprises a palladium or platinum alloy with more than 51 wt. % palladium or platinum in the alloy, wherein the resonant part comprises a first gong, wherein the resonant part has a Young's modulus in a range of from 80 to 180 GPa wherein the first gong is of circular shape and configured to be disposed inside a watch case describing a circular sector with an angle in a range of from 150 to 250°, wherein the resonant part has a hardness greater than 150 HV, wherein the first gong is connected on a first end to the attachment part and a second end is free to move, wherein the first gong has a deflection distance that is less than 20% of its cross-section, and wherein the first gong is configured, once activated, to provide a sound in an audible range of from 1 to 10 KHz.

2. The resonant member of claim 1, wherein palladium or platinum alloy provides a ratio between the Young's modulus and the density or specific mass is smaller than $28 \cdot 10^6$ $(m/s)^2$.

3. The resonant member of claim 1, wherein the resonant part has a hardness in a range of from 300 to 500 HV.

4. The resonant member of claim 1, wherein the resonant part further comprises a second gong.

5. The resonant member of claim 4, wherein the resonant part comprises the first and the second gong, the first gong configured to be disposed on top of the second gong inside a watch case, and wherein the first and second gong have different lengths such that the first and second gong each generate a specific different note once activated for a minute repeater.

6. The resonant member of claim 4, wherein the resonant part comprises the first, the second, a third, and a fourth gong, each having different lengths, such that the first, second, third, and fourth gong each generate a specific different note once activated for a chime mechanism, wherein the first gong and the second gong are configured to be placed on top of each other inside a watch case, wherein the third gong and the fourth gong are configured to be placed on top of each other inside a watch case, wherein the third gong is configured to be coaxially mounted inwardly and coplanar with the first gong, and wherein the fourth gong is configured to be coaxially mounted inwardly and coplanar with the second gong.

7. The resonant member of claim 1, wherein the angle of the circular sector described by the first gong is in a range of from 185 to 220°.

8. The resonant member of claim 7, wherein the first gong has a circular or rectangular cross-section of dimensions greater than or equal to 0.4 mm.

9. The resonant member of claim 1, wherein the palladium or platinum alloy further comprises silver, zinc, indium, tin, titanium, copper, nickel, beryllium, aluminum, ruthenium, gallium, lithium, iridium, germanium, boron, and/or zirconium.

10. The resonant member of claim 1, which is made of metallic glass with more than 51 wt. % of palladium or platinum.

11. The resonant member of claim 4, wherein the gong is obtained by milling, electroerosion, laser machining, molding, casting, or hot pressing.

12. A method for making the resonant member of claim 1, the method comprising:

making the resonant member of a palladium or platinum alloy with more than 51 wt. % of palladium or platinum; and heat treating the resonant member obtained from the making to augment one or more mechanical properties, resistance to corrosion, and/or acoustic properties of the resonant member.

13. A method for making the resonant member of claim 1, the method comprising:

making the resonant member from a palladium or platinum alloy with more than 51 wt. % of palladium or platinum; and surface treating the resonant member obtained from the making to form an additional surface layer of the alloy to improve corrosion resistance and/or its surface hardness of the resonant member.

14. The resonant member of claim 1, wherein the palladium or platinum alloy comprises more than 60 wt. % of the palladium.

15. The resonant member of claim 1, wherein the palladium or platinum alloy comprises more than 60 wt. % of the palladium, wherein the palladium or platinum alloy further comprises nickel and copper.

16. The resonant member of claim 1, wherein the angle of the circular sector described by the first gong is in a range of from 185 to 220°.

17. The resonant member of claim 5, wherein the first and second gong are separated each other by a height h2 having a value less than twice a cross-section of the second gong, without deformation.

18. The resonant member of claim 1, which is configured for a watch, and wherein the first gong has a diameter in a range of from 35 to 40 mm.

19. A resonant member suitable for a striking mechanism of a watch or of a music box, the resonant member comprising:

a resonant part configured to vibrate and resonate once activated, wherein the resonant part comprises a palladium or platinum alloy comprising more than 60 wt. % of the palladium, wherein the resonant part comprises a first gong, wherein the resonant part has a Young's modulus in a range of from 80 to 180 GPa wherein the first gong is of circular shape and configured to be disposed inside a watch case describing a circular sector with an angle in a range of from 150 to 250° C.

wherein the resonant part has a hardness greater than 150 HV, and wherein the palladium or platinum alloy further comprises nickel and copper.

20. The resonant member of claim 19, further comprising:

an attachment part integral with the resonant part in one-piece form.

* * * * *